US012751525B2

(12) United States Patent
Chayahara et al.

(10) Patent No.: US 12,751,525 B2
(45) Date of Patent: Oct. 6, 2026

(54) SLIDER FOR A SLIDE FASTENER

(71) Applicant: YKK Corporation, Tokyo (JP)

(72) Inventors: Yuki Chayahara, Kurobe (JP); Koji Yamagishi, Kurobe (JP)

(73) Assignee: YKK Corporation, Tokyo (JP)

( * ) Notice: Subject to any disclaimer, the term of this patent is extended or adjusted under 35 U.S.C. 154(b) by 46 days.

(21) Appl. No.: 18/837,368

(22) PCT Filed: May 16, 2022

(86) PCT No.: PCT/JP2022/020431

§ 371 (c)(1),
(2) Date: Aug. 9, 2024

(87) PCT Pub. No.: WO2023/223397

PCT Pub. Date: Nov. 23, 2023

(65) Prior Publication Data

US 2025/0169579 A1 May 29, 2025

(51) Int. Cl.
*A44B 19/26* (2006.01)

(52) U.S. Cl.
CPC ..... *A44B 19/26* (2013.01); *Y10T 24/2561* (2015.01)

(58) Field of Classification Search
CPC ..... Y10T 24/2589; Y10T 24/2588; Y10T 24/2586; Y10T 24/2584; Y10T 24/2582; Y10T 24/258; Y10T 24/2579; Y10T 24/2577; Y10T 24/2575; Y10T 24/2573; Y10T 24/2571; Y10T 24/257;
(Continued)

(56) References Cited

U.S. PATENT DOCUMENTS 5,729,874 A 3/1998 Mizuno
9,370,225 B1 * 6/2016 Lin ..... A44B 19/26
(Continued)

FOREIGN PATENT DOCUMENTS

JP H07-213311 A 8/1995
JP H09-168412 A 6/1997
(Continued)

OTHER PUBLICATIONS

WO2012042657 and Translation (Year: 2025).*
(Continued)

*Primary Examiner* — Jason W San
*Assistant Examiner* — Michael S Lee
(74) *Attorney, Agent, or Firm* — Kilpatrick Townsend & Stockton LLP

(57) ABSTRACT

A slider according includes a slider body, a pull, and a cover body and is characterized in that an upper blade of the slider body includes a reference surface, a clearance recess having a shape recessed with respect to the reference surface, and a projection projecting from the reference surface, the reference surface and the clearance recess are disposed in each of left and right side regions, the clearance recess is disposed to include at least a part of an intermediate region provided between the first attachment column and the second attachment column in a length direction, and the projection is disposed at the rear of the intermediate region. Consequently, even when the slider is subjected to a coating process, a possibility of occurrence of fixation of the pull due to a coating material can be reduced.

8 Claims, 8 Drawing Sheets

(58) Field of Classification Search
CPC ..... Y10T 24/2568; Y10T 24/2566; Y10T 24/2564; Y10T 24/2563; Y10T 24/2561; A44B 19/26; A44B 19/262; A44B 19/27; A44B 19/24; A44B 19/265; A44B 19/28; A44B 19/30; A44B 19/301; A44B 19/303; A44B 19/305; A44B 19/306; A44B 19/308
See application file for complete search history.

(56) References Cited

U.S. PATENT DOCUMENTS

| | | | | |
|---|---|---|---|---|
| 2012/0204384 | A1* | 8/2012 | Miyazaki | A44B 19/26 24/420 |
| 2014/0338158 | A1* | 11/2014 | Lin | A44B 19/26 24/431 |
| 2023/0210227 | A1 | 7/2023 | Ozawa et al. | |

FOREIGN PATENT DOCUMENTS

| | | | | |
|---|---|---|---|---|
| WO | WO-2012042657 | A1 * | 4/2012 | A44B 19/306 |
| WO | 2016/189616 | A1 | 12/2016 | |
| WO | 2021/250748 | A1 | 12/2021 | |

OTHER PUBLICATIONS

International Preliminary Report on Patentability, PCT Patent Application No. PCT/JP2022/020431, Nov. 28, 2024, 7 pages.
International Search Report, PCT Patent Application No. PCT/JP2022/020431, Jul. 5, 2022, 5 pages.
Written Opinion, PCT Patent Application No. PCT/JP2022/020431, Jul. 5, 2022, 3 pages.

* cited by examiner

SLIDER FOR A SLIDE FASTENER

TECHNICAL FIELD

The present invention relates to a slider to be used for a slide fastener.

BACKGROUND ART

Sliders for slide fasteners are disclosed in International Publication 2021/250748 (PTL 1) and the other literatures. For example, as illustrated in FIG. 8, a slider 70 in the related art is formed with a slider body 71, a pull 72, a stopper pawl body 73, a plate spring member (elastic member) 74, and a cover body 75. The slider 70 is assembled by placing the pull 72, the stopper pawl body 73, and the plate spring member 74 sequentially on the slider body 71 and then attaching the cover body 75 to front and rear attachment columns 71*a* provided at the slider body 71.

The slider 70 includes an automatic stopping mechanism constituted by the stopper pawl body 73. Specifically, when the pull 72 of the slider 70 is not operated, the stopper pawl body 73 is urged by the plate spring member 74, and the pawl portion 73*a* of the stopper pawl body 73 is thereby caused to automatically enter an element guide passage 71*b* of the slider body 71. Consequently, the pawl portion 73*a* of the stopper pawl body 73 that has entered the element guide passage 71*b* engages with element rows inserted into the element guide passage 71*b*. As a result, a stopped state of the slider 70 can be maintained so that the slider 70 does not freely move along the element rows.

CITATION LIST

Patent Literature

PTL 1: International Publication No. 2021/250748

SUMMARY OF INVENTION

Technical Problem

After the above-described slider 70 in the related art is assembled, the assembled slider 70 is generally subjected to surface treatment, such as coating. As a method of coating sliders, for example, spraying a coating material onto an assembled slider by a spray is known.

However, when sliders in the related art are dried after subjected to a coating process, such as coating by a spray, a problem that a pull is immobilized by being fixed to a slider body occurs in some of the sliders due to a coating material that is dried with the pull being in contact with an upper blade of the slider body. Further, a problem that the pull fixed to the slider body by the coating material comes off and thereby leaves a mark of the pull on the slider body may occur. Sliders in which such problems have occurred are eliminated as defective products and can be one of causes of reduction in productivity and reduction in yield.

The present invention has been made in consideration of the aforementioned problems in the related art, and an object of the present invention is to provide a slider that is capable of, even when subjected to a coating process, reducing a possibility of occurrence of fixation of a pull to a slider body due to a coating material.

Solution to Problem

To achieve the aforementioned object, a slider provided by the present invention is a slider including at least a slider body, a pull including an attachment shaft portion, and a cover body, the slider body including an upper blade, a lower blade disposed away from the upper blade, a coupling column coupling a front end portion of the upper blade and a front end portion of the lower blade, a first attachment column on a front side, and a second attachment column on a rear side, the first attachment column and the second attachment column extending upward from the upper blade, the cover body being attached to the first attachment column and the second attachment column of the slider body, the attachment shaft portion of the pull being disposed between the first attachment column and the second attachment column of the slider body and being held between the upper blade and the cover body, the slider being for a slide fastener. In the slider, the upper blade includes a reference surface that is exposed to an upper side, a clearance recess that has a shape recessed with respect to the reference surface, and a projection that projects from the reference surface and that supports a part of the pull when the pull is tilted, the reference surface and the clearance recess are disposed in each of left side and right side regions on an outer side of the first attachment column and the second attachment column in a slider width direction, the clearance recess is disposed to include at least a part of an intermediate region that is provided between the first attachment column and the second attachment column in a slider length direction, and the projection is disposed at a rear of the intermediate region in the slider length direction.

In the slider according to the present invention, preferably, the upper blade includes a shaft support that supports the attachment shaft portion of the pull, and the shaft support is disposed in at least a part of the intermediate region in the slider length direction.

In the slider according to the present invention, preferably, in the slider length direction, a front end of the clearance recess is disposed forward the intermediate region, and a rear end of the clearance recess is disposed between the intermediate region and the projection.

In addition, preferably, the clearance recess has a bottom surface that is curved into a shape recessed with respect to the slider length direction, and the bottom surface of the clearance recess is formed to be smoothly continuous from the reference surface.

Further, preferably, the bottom surface of the clearance recess is formed by a curved surface that is parallel to the slider width direction.

In the slider according to the present invention, preferably, the shaft support is disposed inside the left and right clearance recesses in the slider width direction and is disposed at a height position same as a height position of the reference surface in a slider height direction.

Preferably, in side view of the slider in which the slider is viewed in the slider width direction, a non-contact region in which the pull does not come into contact with the upper blade is provided between the upper blade and the pull when the pull is tilted.

In addition, preferably, in side view of the slider in which the slider is viewed in the slider width direction, when a dimension from a position of a center of the attachment shaft portion of the pull while the pull is tilted to a position of a tip of the projection in the slider length direction is defined as a reference dimension, a dimension from a front end of the clearance recess (22) to a rear end of the clearance recess in the slider length direction is 50% or more of the reference dimension.

Further, preferably, a maximum depth of the clearance recess from the reference surface in the slider height direction is 2% or more and 10% or less of a dimension of the upper blade from the reference surface to a lower surface of the upper blade in the slider height direction.

Advantageous Effects of Invention

With the slider according to the present invention, it is possible even when the slider is subjected to a coating process to reduce a possibility of occurrence of fixation of a pull to a slider body due to a coating material and thus is possible to improve the productivity of the slider and increase the yield of the slider.

DESCRIPTION OF EMBODIMENTS

Hereinafter, a suitable embodiment of the present invention will be described in detail with reference to the drawings.

Figure 1:
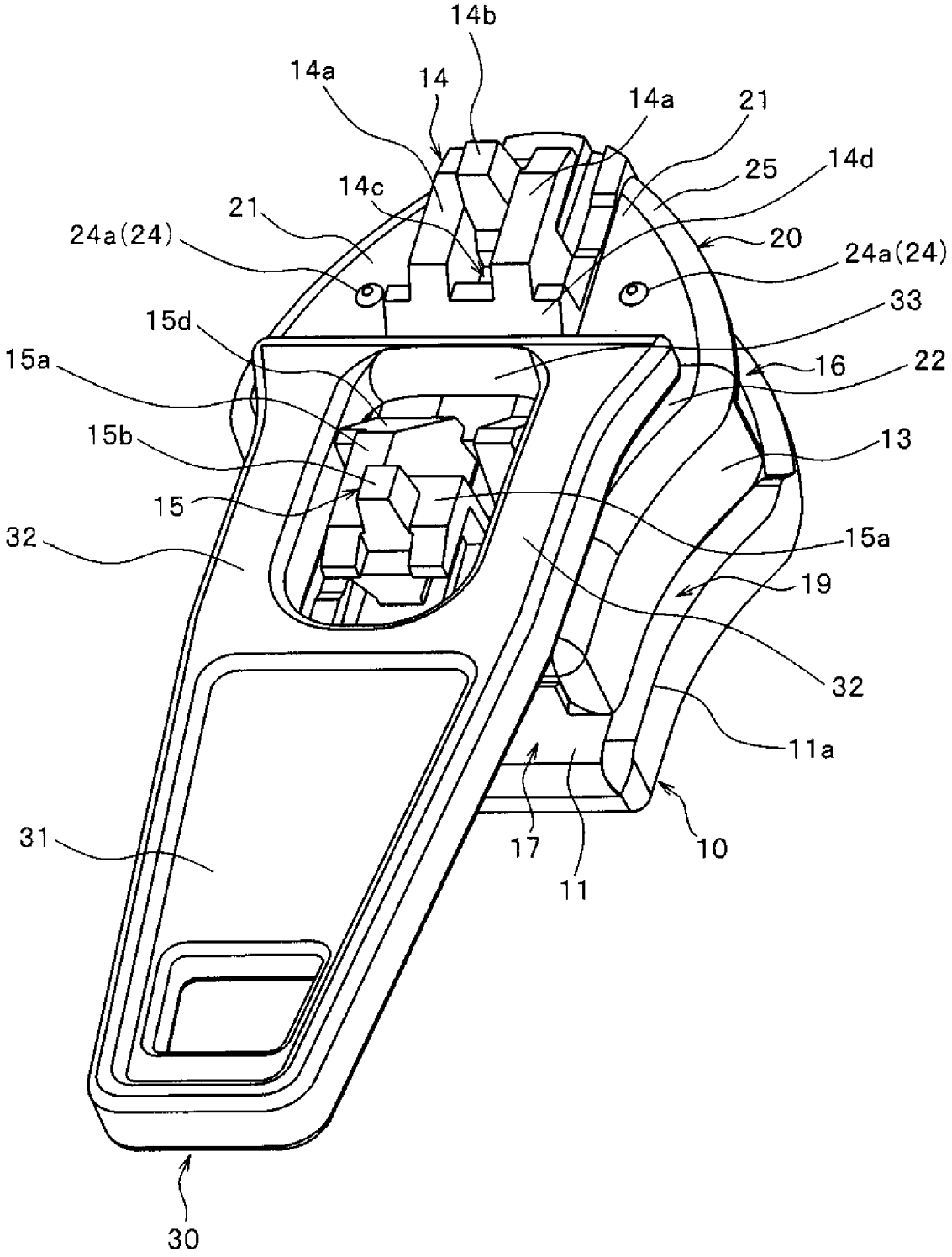
FIG. 1 is a schematic perspective view of a slider body and a pull of a slider according to an embodiment of the present invention.
Figure 2:
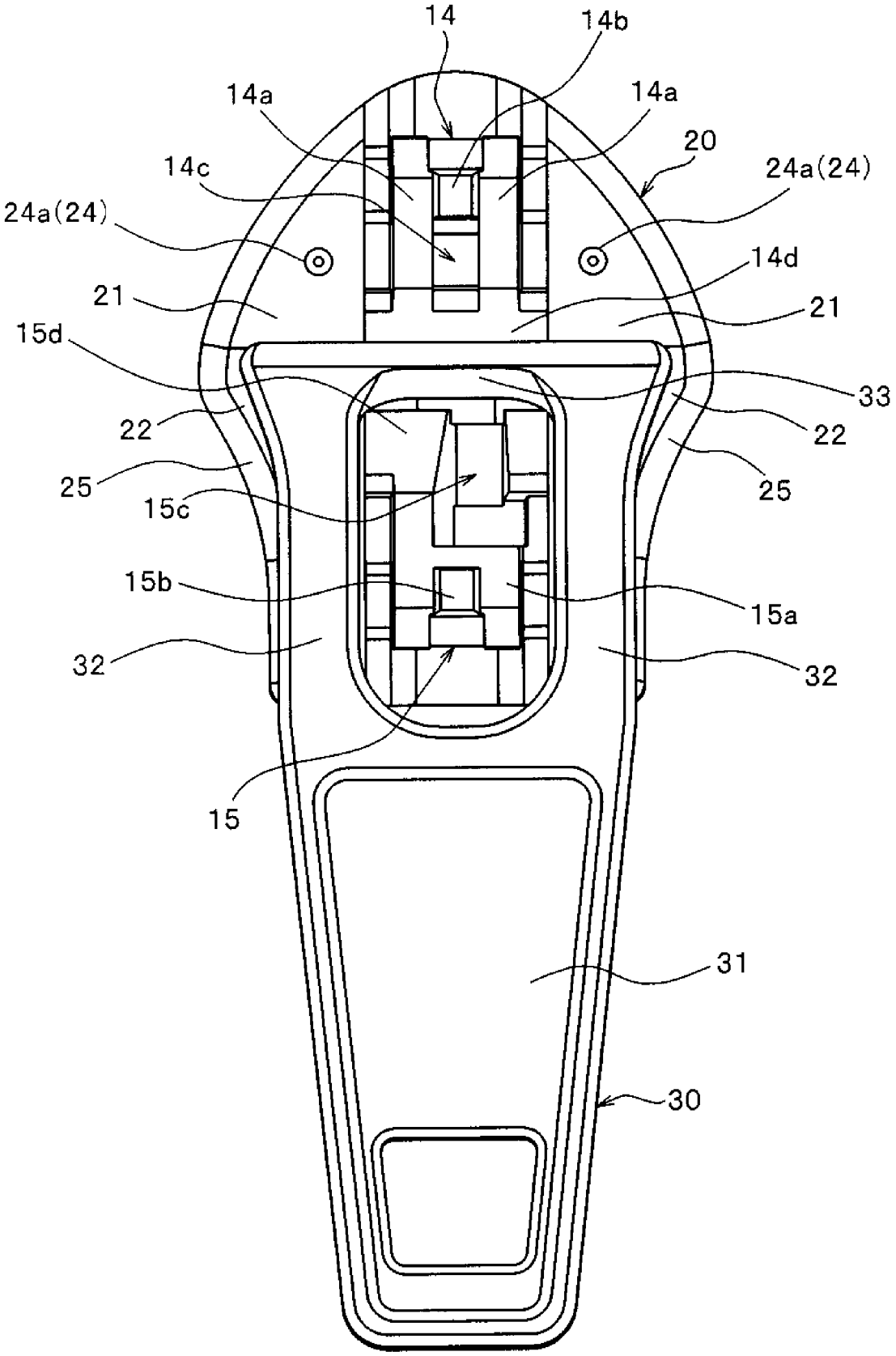
FIG. 2 is a plan view of the slider body and the pull illustrated in FIG. 1.
Figure 3:
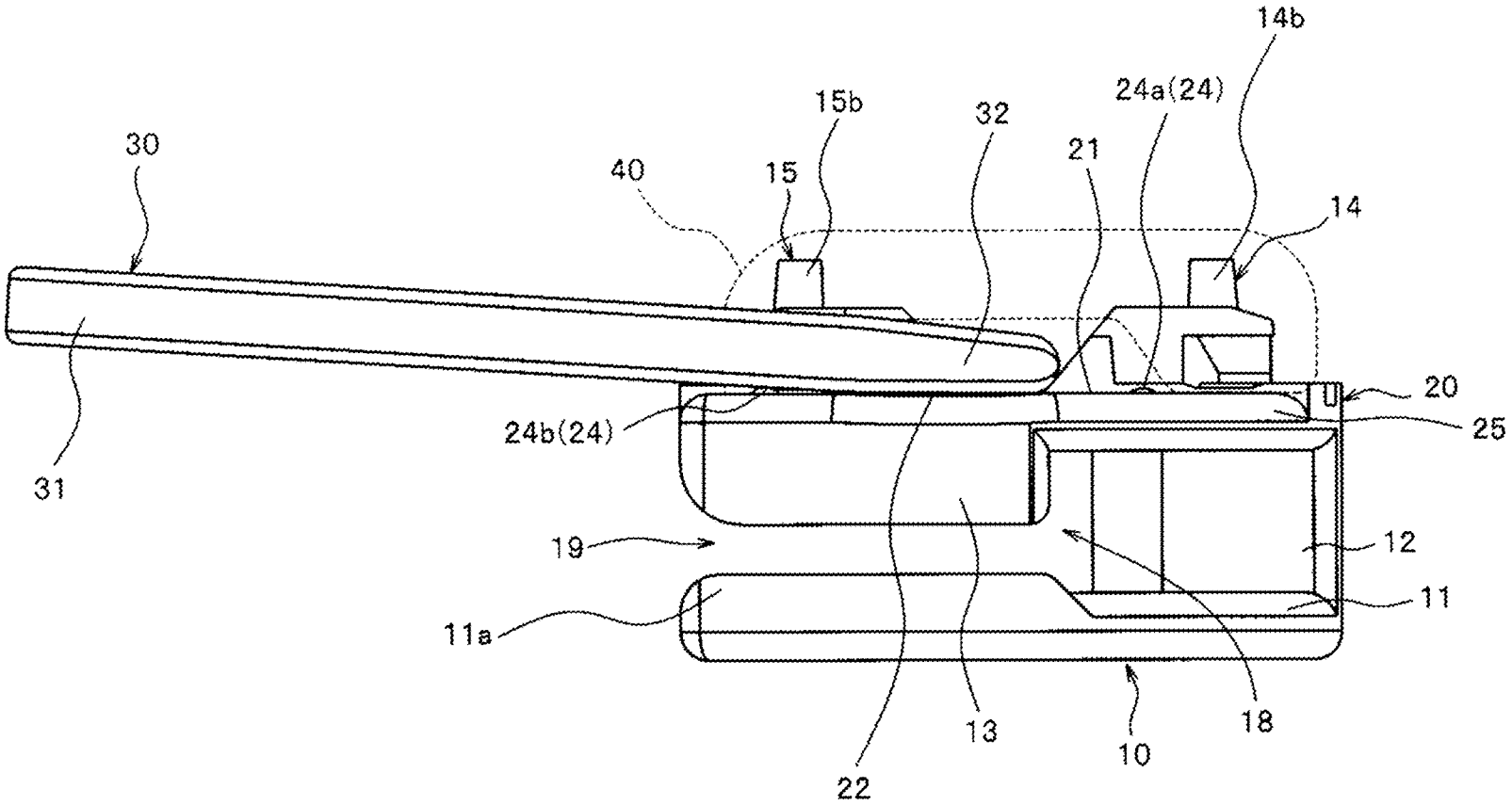
FIG. 3 is a side view of the slider body and the pull illustrated in FIG. 1.
Figure 4:
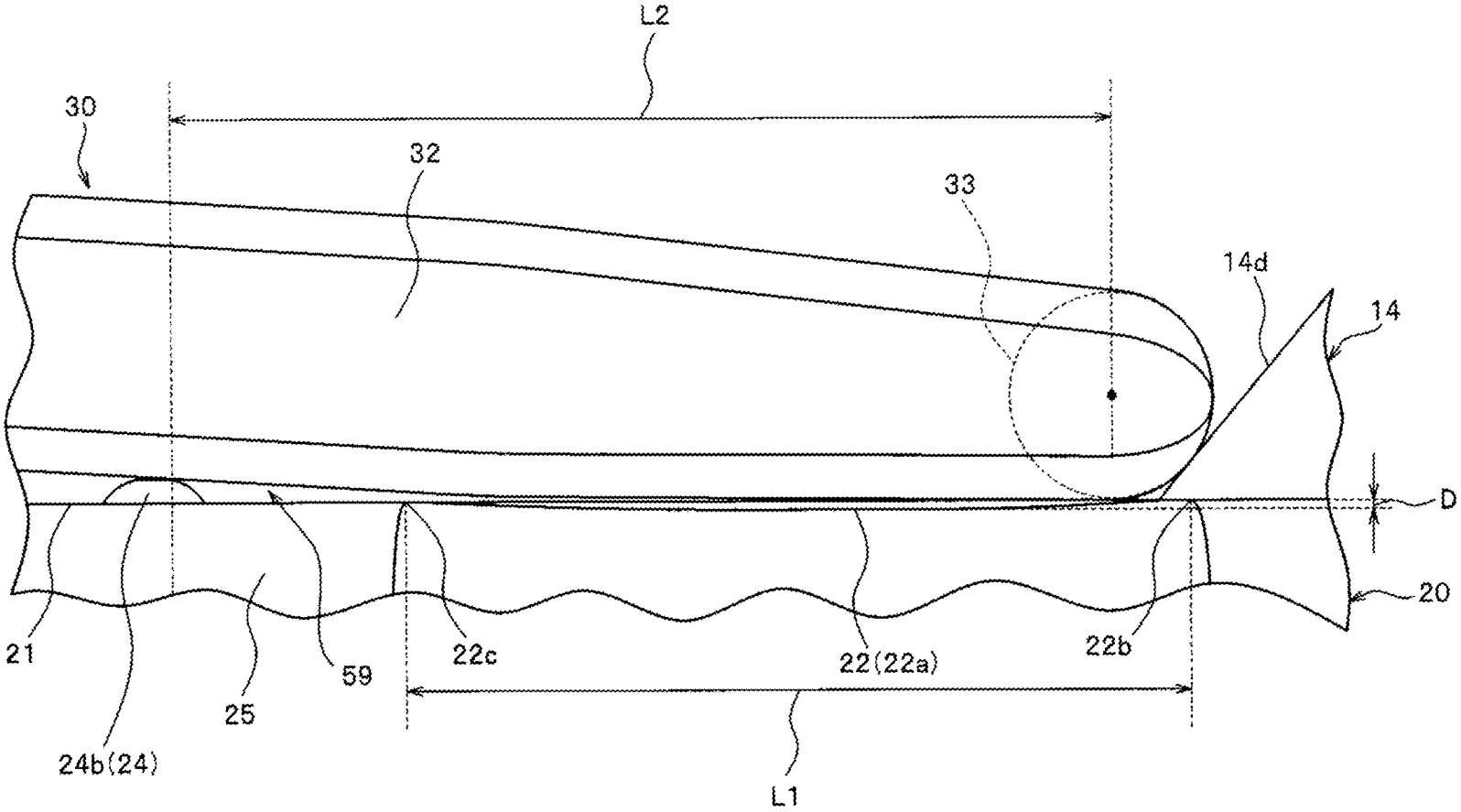
FIG. 4 is an enlarged schematic view of principal a part of the slider body and the pull.

FIG. 1 is a schematic perspective view of a slider body and a pull of a slider in the present embodiment. FIG. 2 and FIG. 3 are a plan view and a side view, respectively, of the slider body and the pull. In FIG. 3, a cover body is indicated by a broken line. FIG. 4 is a schematic view illustrating a relationship between an upper blade of the slider body and the pull.

In the following description, the front-rear direction denotes a length direction or a sliding direction of the slider. In particular, a direction to which the slider used for a slide fastener moves to engage left and right element rows with each other is considered as front (a shoulder-port-side direction), and a direction (rear-port-side direction) to which the slider moves to separate the element rows from each other is considered as rear.

The up-down direction denotes the height direction of the slider, and the up-down direction is a direction orthogonal to, for example, a reference surface, which is described later, of the upper blade of the slider body. In particular, a side of the slider where the pull is attached to the slider body is considered as the upper side, and a side opposite thereto is considered as the lower side. The left-right direction denotes the width direction of the slider, and the left-right direction is a direction orthogonal to the length direction and the height direction of the slider.

The slider in the present embodiment is used by being slidably attached to left and right element rows of a slide fastener. In this case, the left and right element rows provided at the slide fastener are each formed by a plurality of continuous coil-shaped fastener elements. The coil-shaped element rows are inserted into an element guide passage 18, which is described later, of the slider, and the slider is thereby attached to the element rows. The left and right element rows can be engaged with and separated from each other by the slider being slid along the element rows.

The slider in the present embodiment is provided with an automatic stopping mechanism constituted by a stopper pawl body (not illustrated) that is capable of automatically maintaining a stopped state of the slider when the slider is stopped with respect to the element rows. The slider according to the present invention may be formed without the automatic stopping mechanism.

The slider in the present embodiment is formed by five components, which are a slider body 10, a pull 30, a stopper pawl body (not illustrated), an elastic member (not illustrated), and a cover body 40. In the present embodiment, the elastic member is formed by a plate spring member.

The slider in the present embodiment has main features in the slider body 10 (in particular, an upper blade 20 of the slider body 10), and the shapes, structures, materials, and the like of the stopper pawl body, the elastic member (plate spring member), and the cover body 40 are not particularly limited in the present invention. Thus, the slider body 10 and the pull 30 will be mainly described below. The stopper pawl body, the elastic member, and the cover body 40 are formed substantially similarly to those that have been generally used, and thus, detailed description thereof is omitted.

In the present embodiment, the pull 30 includes a pull body portion 31 that is to be held between, for example, fingers, left and right arm portions 32 that extend from one end portion of the pull body portion 31, and an attachment shaft portion 33 that couples tip portions of the left and right arm portions 32 to each other. A cross-section of the attachment shaft portion 33 orthogonal to an axial direction (slider width direction) of the attachment shaft portion 33 is circular. The pull 30 has a rectangular open window portion surrounded by the pull body portion 31, the left and right arm portions 32, and the attachment shaft portion 33. In the present invention, the shape, the size, the material, and the like of the pull are not particularly limited.

The slider body 10 in the present embodiment includes the upper blade 20; a lower blade 11 that is disposed away from the upper blade 20; a coupling column 12 that couples a front end portion (shoulder-port-side end portion) of the upper blade 20 and a front end portion (shoulder-port-side end portion) of the lower blade 11 to each other; left and right upper flange portions 13 that are provided at left and right side portions of the upper blade 20, respectively; a first attachment column (front attachment column) 14 that is on the front side by being provided at the front end portion of the upper blade plate 20; and a second attachment column (rear attachment column) 15 that is on the rear side by being provided at a rear end portion of the upper blade 20. Left and right side edge portions of the rear half portion of the lower blade 11 are provided with left and right bulge portions, respectively, bulging toward the upper blade 20.

A front end portion of the slider body 10 has left and right shoulder ports 16 with the coupling column 12 interposed therebetween. A rear end portion of the slider body 10 has a rear port 17. The element guide passage 18 having a substantially Y-shape and through which the left and right shoulder ports 16 are in communication with the rear port 17 is formed between the upper blade 20 and the lower blade 11 of the slider body 10. Left and right side edge portions of the slider body 10 are each provided with a tape insertion gap 19 into which a corresponding one of left and right fastener tapes (not illustrated) of a slide fastener is to be inserted. In this case, the left and right tape insertion gaps 19 of the slider body 10 are each formed between the corresponding left or right upper flange portion 13 and a bulge portion 11*a* of the lower blade 11.

Figure 5:
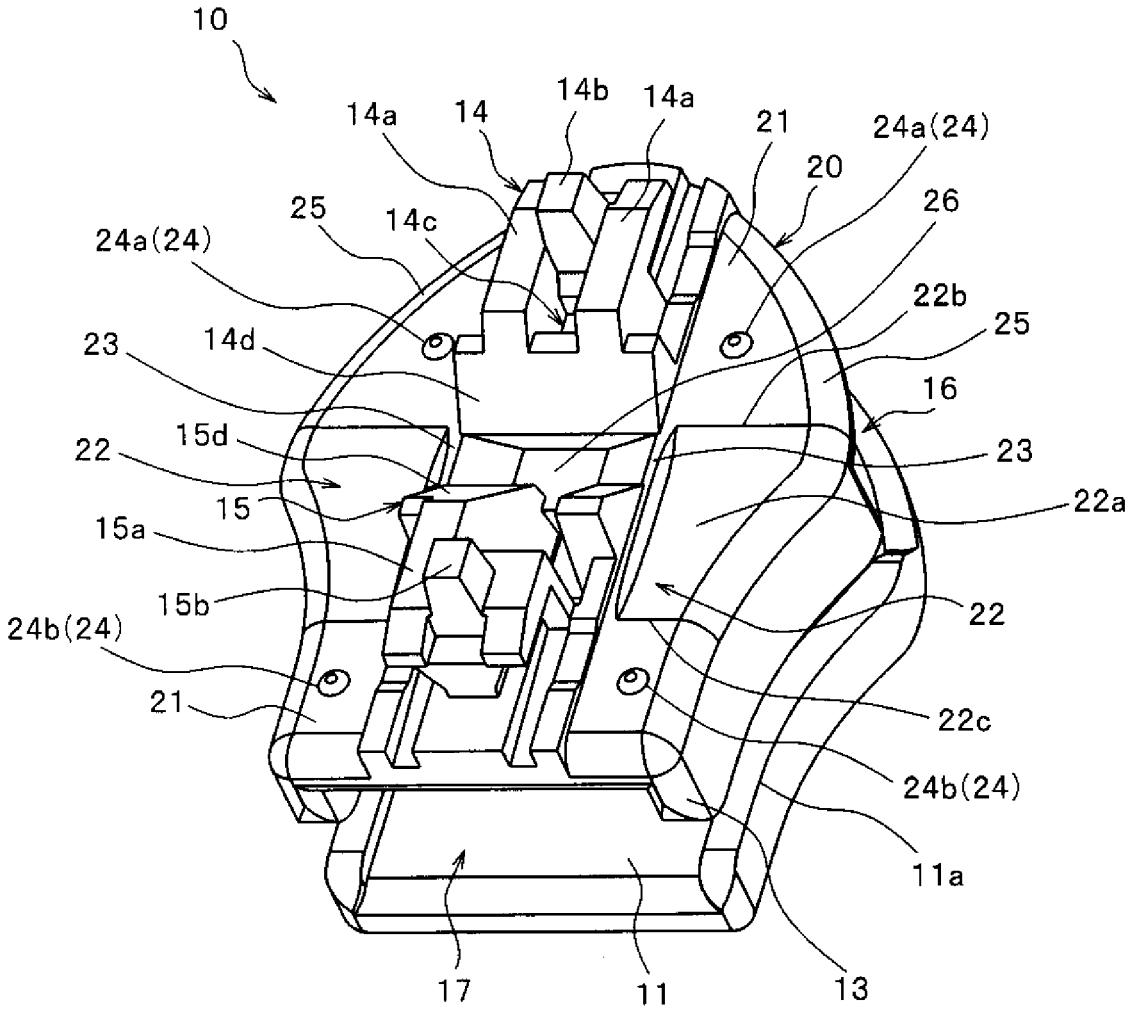
FIG. 5 is a perspective view of the slider body.
Figure 6:
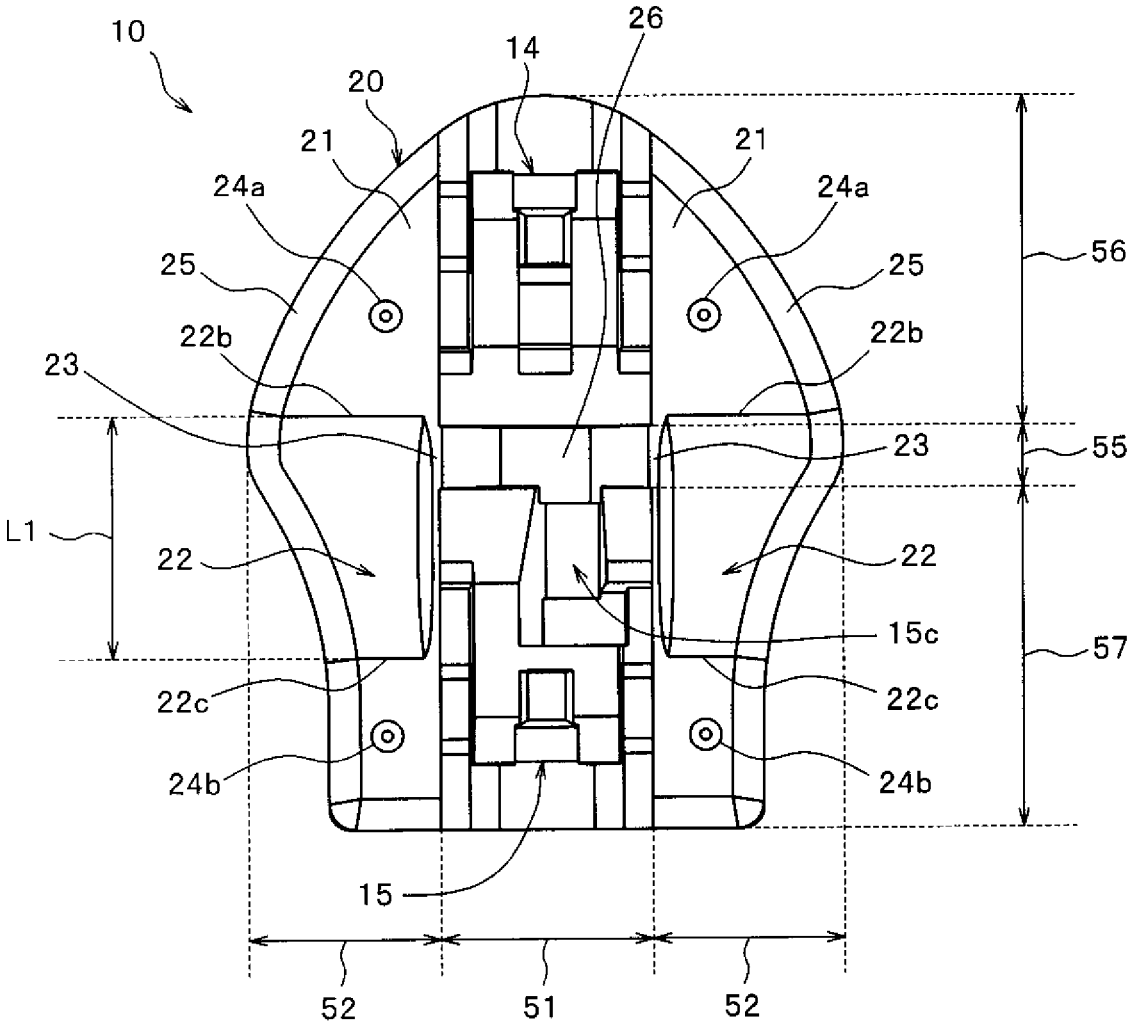
FIG. 6 is a plan view of the slider body.
Figure 7:
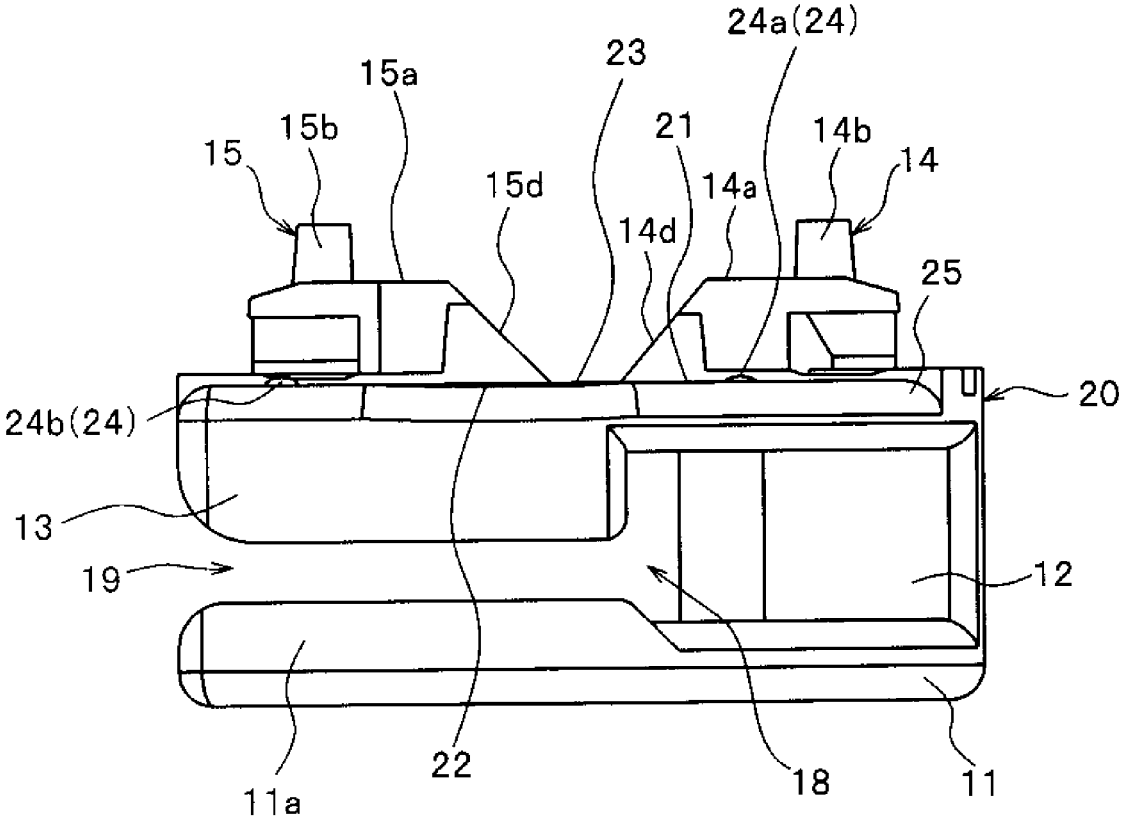
FIG. 7 is a side view of the slider body.
Figure 8:
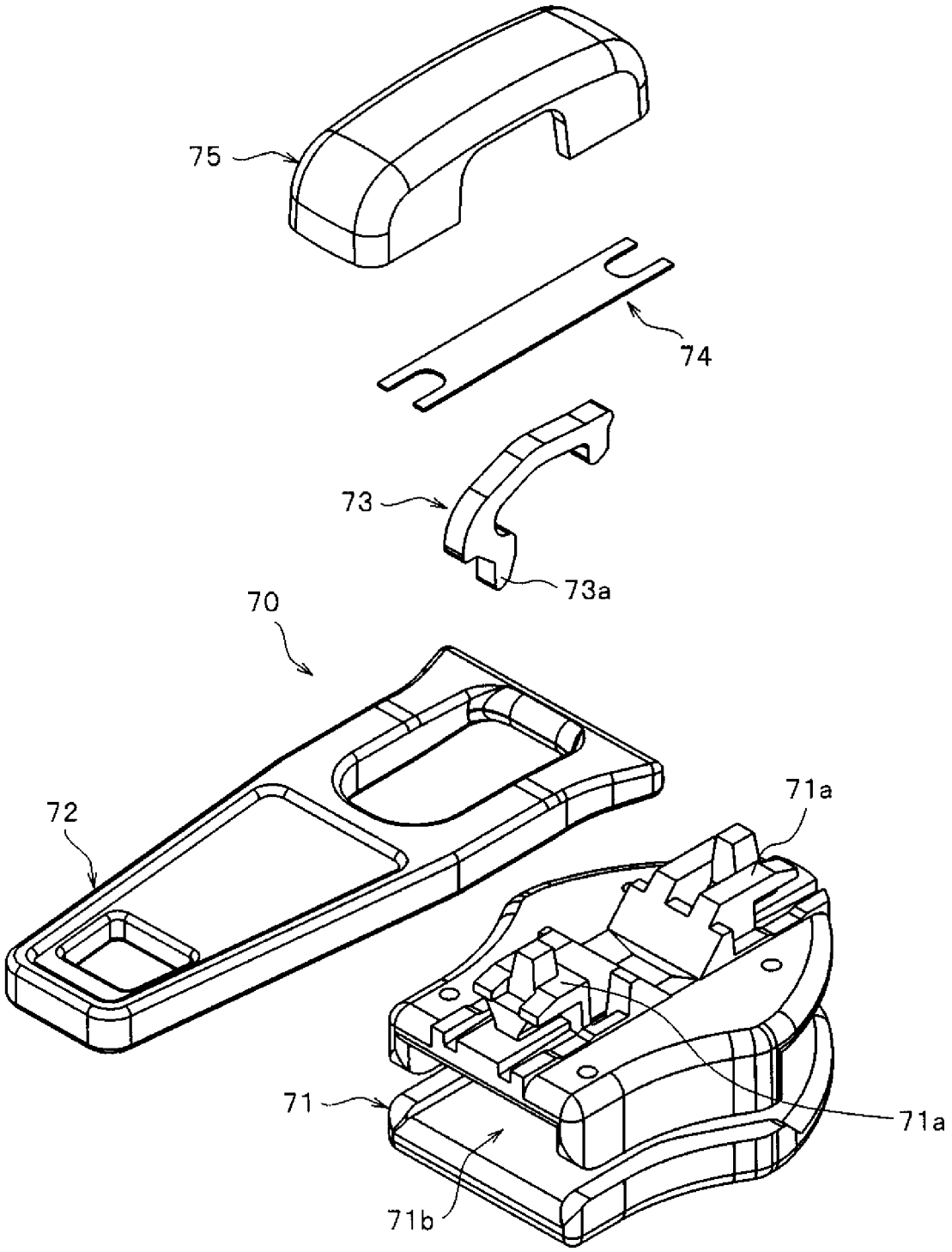
FIG. 8 is an exploded perspective view illustrating an exploded state of a slider in the related art.

As illustrated in FIG. 5 and FIG. 6, the upper blade 20 in the present embodiment includes a reference surface 21 that is exposed to the upper side; left and right clearance recesses 22 that are recessed with respect to the reference surface 21; left and right shaft supports 23 that support the attachment shaft portion 33 of the pull 30; four projections 24 that project from the reference surface 21; and left and right side edge portions 25 that each have a smoothly curved outer surface.

Here, regarding the upper blade 20 in the present embodiment, for example as illustrated in FIG. 6, a section in which the first attachment column 14 and the second attachment column 15 are formed in the left-right direction (slider width direction) is defined as a central region 51, and sections on the left and right sides of the central region 51 are defined as side regions 52. In addition, regarding the upper blade 20, a section between the first attachment column 14 and the second attachment column 15 in the front-rear direction (slider length direction) is defined as an intermediate region 55, and a section at the front of the intermediate region 55 and a section at the rear of the intermediate region 55 are defined as a front region 56 and a rear region 57, respectively. In this case, the intermediate region 55 of the upper blade 20 is a region that extends from the rear edge (specifically, the rear edge of a first inclined surface 14*d*, which is described later, of the first attachment column 14) of the first attachment column 14 to the front edge (specifically, the front edge of a second inclined surface 15*d*, which is described later, of the second attachment column 15) of the second attachment column 15 in the front-rear direction.

In the present embodiment, the reference surface 21 of the upper blade 20 is an upper surface of the upper blade 20 orthogonal to the up-down direction and is formed by a flat surface. The reference surface 21 is provided in each of the left and right side regions 52 of the upper blade 20 in the left-right direction. The reference surface 21 is also provided in at least a part of the front region 56 of the upper blade 20 and at least a part of the rear region 57 in the front-rear direction.

In particular, due to the flat reference surface (upper surface) 21 being provided in each of the left and right side regions 52 at the front end portion of the upper blade 20 in which a width dimension (dimension in the left-right direction) gradually decreasing toward the front and being provided in each of the left and right side regions 52 at the rear end portion of the upper blade 20 close to the rear port 17 side, it is possible in the present embodiment to smoothly perform an insertion step in which, for example, after the slider in the present embodiment is manufactured, left and right element rows are inserted into the slider.

Specifically, for example, after the slider in the present embodiment is manufactured, an insertion step of mechanically inserting the left and right element rows of a fastener chain into the element guide passage 18 of the slider is performed. In the insertion step, first, to insert the element rows into the slider, the front end portion and the rear end portion of the upper blade 20 and the front end portion and the rear end portion of the lower blade 11 in the slider body 10 are sandwiched and pressed by a slider holder in the up-down direction, and the slider is thereby held by the slider holder. At this time, due to the flat reference surface 21 of the upper blade 20 being provided, as in the present embodiment, in each of the left and right side regions 52 at the front end portion and the rear end portion of the upper blade 20, it is possible to stably hold the slider in a fixed orientation by the slider holder. It is thus possible to smoothly and stably perform an operation of inserting the left and right element rows into the element guide passage 18 of the slider by a machine.

The four projections 24 provided on the upper blade 20 have shapes and sizes that are identical to each other. Each of the projections 24 has a circular tip surface (upper end surface) parallel to the reference surface 21 of the upper blade 20, and an outer circumference surface extending from the outer circumference edge of the tip surface to the reference surface 21. The outer circumference surface of the projection 24 has a substantially spherical shape. The shape of each of the projections 24 is not particularly limited in the present invention.

The projections 24 in the present embodiment include a left-right pair of first projections 24*a* that are disposed at the front of the intermediate region 55 of the upper blade 20 while being provided on the left and right sides of the first attachment column 14, and a left-right pair of second projections 24*b* that are disposed at the rear of the intermediate region 55 of the upper blade 20 while being provided on the left and right sides of the second attachment column 15. In this case, the first projections 24*a* on the front side are disposed one each in the left and right side regions 52 in the front region 56 of the upper blade 20. The second projections 24*b* on the rear side are disposed one each in the left and right side regions 52 in the rear region 57 of the upper blade 20.

In the present embodiment, the height dimension (in other words, a dimension between the reference surface 21 and the tip surface of each of the projections 24 in the up-down direction) of each of the projections 24 from the reference surface 21 is 3% or more and 20% or less, preferably, 5% or more and 15% or less of the thickness dimension (in other words, a dimension from an element guide surface of the upper blade 20 facing the element guide passage 18 to the reference surface 21 in the up-down direction) of the upper blade 20.

Due to the height dimension of each of the projections 24 being set to 3% or more of the thickness dimension of the upper blade 20, it is possible to cause the pull 30 to come into contact with the left and right projections 24 to be supported by the projections 24 when the pull 30 is tilted toward the shoulder ports 16 or toward the rear port 17 with respect to the slider body 10, and consequently, it is possible to separate the pull 30 at least in the vicinity of the projections 24 in the front-rear direction from the reference surface 21 of the upper blade 20.

Due to the height dimension of each of the projections 24 being set to 20% or less of the thickness dimension of the upper blade 20, it is possible to make the projections 24 less noticeable in the external appearance of the slider. It is also possible to reduce a possibility of fingers being caught on the projections 24, for example, when the slider body 10 is touched by the fingers. Specifically, the height dimension of each of the projections 24 from the reference surface 21 is set to, for example, 0.05 mm or more and 0.30 mm or less in the present embodiment.

As illustrated in FIG. 6, the first projections 24*a* on the front side are disposed at positions closer than the second projections 24*b* on the rear side to the intermediate region 55 in the front-rear direction. Consequently, when the pull 30 is tilted toward the shoulder ports 16 of the slider body 10, it is possible to separate the pull 30 in the vicinity of the projections 24 largely from the reference surface 21 of the upper blade 20 compared with, for example, the pull 30 that is tilted toward the rear port 17 of the slider body 10.

To reduce the area in which the pull 30 comes into contact with the upper blade 20 when the pull 30 is tilted toward the rear port 17, the clearance recesses 22 are provided one each in the left and right side regions 52 of the upper blade 20 and are formed to be recessed downward with respect to the reference surface 21 of the upper blade 20. In the present embodiment, the left and right clearance recesses 22 are formed to be left-right symmetrical with respect to a centerline of the upper blade 20 in the left-right direction.

The left and right clearance recesses 22 each have a bottom surface 22*a* that is curved into a shape recessed downward with respect to the front-rear direction, and the bottom surface 22*a* is formed to be a curved surface in a smooth recessed surface shape. In other words, each clearance recess 22 is formed such that the depth of the clearance recess 22 is deepest at a central portion of the clearance recess 22 in the length direction thereof and such that the depth of the clearance recess 22 gradually decreases from the central portion of the clearance recess 22 toward the front and toward the rear. Here, the depth of the clearance recess 22 is a dimension from the bottom surface 22*a* of the clearance recess 22 to the reference surface 21 in the up-down direction.

In the present embodiment, a maximum depth D (in other words, the depth at the central portion of each clearance recess 22) of each clearance recess 22 is set to 2% or more and 10% or less, preferably, 3% or more and 8% or less of the thickness dimension of the upper blade 20 (refer to FIG. 4). The maximum depth D of each clearance recess 22 is also set to 25% or more and 50% or less of the height dimension of each projection 24 from the reference surface 21.

With each of the clearance recesses 22 having the maximum depth D that is 2% or more of the thickness dimension of the upper blade 20, when the pull 30 is tilted toward the rear port 17 of the slider body 10 as illustrated in FIG. 4, a gap (for example, a gap of 0.03 mm or more) can be easily provided between the pull 30 and the bottom surface 22*a* of each of the clearance recesses 22. In addition, with each of the clearance recesses 22 having the maximum depth D that is 10% or less of the thickness dimension of the upper blade 20, decrease in the strength of the upper blade 20 due to the provision of the clearance recesses 22 can be suppressed. For example, the maximum depth D of each of the clearance recesses 22 is set to 0.02 mm or more and 0.5 mm or less in the present embodiment.

In the present invention, each clearance recess 22 may be formed such that the bottom surface 22*a* of the clearance recess 22 is not a curved surface such as that in the present embodiment and is, for example, formed to include a flat surface parallel to the front-rear direction or a flat surface inclined with respect to the front-rear direction. For example, in FIG. 1, FIG. 2, FIG. 5, and FIG. 6, for easy understanding of the range of formation of each clearance recess 22, lines that indicate boundaries are illustrated between the bottom surface 22*a* of each clearance recess 22 and the reference surface 21 provided at the front and rear of the clearance recess 22. However, in the actual slider body 10, the bottom surface 22*a* of each clearance recess 22 is formed to be smoothly continuous from the reference surface 21 at the front and rear thereof as illustrated in, for example, FIG. 4 so that boundaries between the bottom surface 22*a* and the reference surface 21 are not visually recognized clearly.

Due to such left and right clearance recesses 22 being provided on the upper blade 20, when the pull 30 is tilted toward the rear port 17 with respect to the slider body 10 and comes into contact (refer to FIG. 3 and FIG. 4) with the left and right second projections 24*b*, it is possible to reduce a region (contact area) in which the pull 30 comes into direct contact with the upper blade 20 compared with, for example, a case where the clearance recesses 22 are not provided on the upper blade 20.

The left and right clearance recesses 22 are each formed continuously from a position in a corresponding one of the side regions 52 close to the central region 51 toward the outer side in the width direction (refer to FIG. 6). In this case, a thin and long reference surface 21 extending in the front-rear direction is formed between each of the clearance recesses 22 and the central region 51. In the present invention, each of the left and right clearance recesses 22 may be formed to extend inward in the left-right direction to the position of the boundary between the central region 51 and a corresponding one of the side regions 52.

The bottom surface 22*a* of each of the clearance recesses 22 extends parallel to the left-right direction and thus has a surface shape that is constant in the left-right direction. Due to the bottom surface 22*a* of each of the left and right clearance recesses 22 being formed, as described above, smoothly to be continuous with the reference surface 21 at the front and rear thereof and being formed parallel to the left-right direction, it is possible, even when the recessed clearance recesses 22 are provided on the upper surface of the upper blade 20, to make the clearance recesses 22 less noticeable in the external appearance of the slider. Therefore, it is possible to reduce or eliminate the influence of the clearance recesses 22 on the external appearance quality of the slider.

In the front-rear direction, the left and right clearance recesses 22 are each formed to include at least a part of at least the intermediate region 55, preferably, to include the entirety of the intermediate region 55 (refer to FIG. 6). For example, a front end (front edge) 22*b* of each of the clearance recesses 22 is disposed at the front of the intermediate region 55 in the front-rear direction, specifically, is disposed between the intermediate region 55 and the first projections 24*a* on the front side in the present embodiment. A rear end (rear edge) 22*c* of each of the clearance recesses 22 is disposed at the rear of the intermediate region 55 in the front-rear direction, specifically, is disposed between the intermediate region 55 and the second projections 24*b* on the rear side. Consequently, an area in which the pull 30 comes into contact with the upper blade 20 when the pull 30 is tilted toward the rear port 17 can be stably reduced.

Further, in the present embodiment, each clearance recess 22 is provided such that the dimension thereof from the intermediate region 55 to the rear end 22*c* of the clearance recess 22 in the front-rear direction is larger than the dimension thereof from the intermediate region 55 to the front end 22*b* of the clearance recess 22 in the front-rear direction. Consequently, when the first projections 24*a* on the front side are disposed, as in the present embodiment, at positions closer than the second projections 24*b* on the rear side to the intermediate region 55, it is possible to reduce the size of each clearance recess 22 in the front-rear direction while, as described above, ensuring the effect of reducing the area of contact of the pull 30 with the upper blade 20.

For example, in the present embodiment, when the dimension of each clearance recess 22 from the front end 22*b* to the rear end 22*c* in the front-rear direction is defined as a length dimension L1 of the clearance recess 22, the length dimension L1 of the clearance recess 22 is set to be larger than the dimension of the intermediate region 55 in the front-rear direction and to be smaller than the dimension from the first projections 24*a* on the front side to the second projections 24*b* on the rear side in the front-rear direction.

Further, for example, when the dimension from the position of the center (axial center) of the attachment shaft portion 33 of the pull 30 while the pull 30 is tilted toward the rear port 17 with respect to the slider body 10 to the position (in other words, a position of contact between the pull 30 and the projections 24) of the tip surface of each of the projections 24 of the upper blade 20 on the rear side in the slider length direction is defined as a reference dimension L2, the length dimension L1 of each of the clearance recesses 22 is set to be 50% or more of the reference dimension L2 (refer to FIG. 4). Due to the clearance recesses 22 each having the length dimension L1 that is 50% or more of the reference dimension L2 as described above, it is possible to effectively reduce the area in which the pull 30 tilted toward the rear port 17 comes into contact with the upper blade 20.

The length dimension L1 of each of the clearance recesses 22 is preferably set to 100% or less of the reference dimension L2. Consequently, it is possible to suppress decrease in the strength of the upper blade 20 due to the provision of the clearance recesses 22 and also possible to provide the clearance recesses 22 on the upper blade 20 to be less noticeable in the external appearance of the slider.

In the present invention, it is sufficient for the left and right clearance recesses 22 to be provided to each have a size with which at least a part of the intermediate region 55 is included therein in the front-rear direction. Therefore, for example, each clearance recess 22 may be formed such that the front end 22*b* of the clearance recess 22 is disposed in the intermediate region 55 or may be formed to be continuous from a position on the front side of the first projections 24*a* to a position on the rear side of the second projections 24*b* in the front-rear direction.

The left and right shaft supports 23 provided at the upper blade 20 are provided such that the attachment shaft portion 33 of the pull 30 is supported in the intermediate region 55 between the first attachment column 14 and the second attachment column 15. A support surface (upper surface) of each of the left and right shaft supports 23 is disposed at a height position same as a height position of the reference surface 21 of the upper blade 20 in the up-down direction. In other words, the reference surface 21 of the upper blade 20 and the support surfaces of the shaft supports 23 are provided so as to form one flat identical surface (single flat surface). The support surfaces of the left and right shaft supports 23 are thus disposed on the upper side of the bottom surfaces 22*a* of the clearance recesses 22 in the up-down direction. Consequently, when the pull 30 is tilted toward the rear port 17, a gap is easily formed between the pull 30 and the bottom surface 22*a* of each of the clearance recesses 22.

In the present embodiment, the left and right shaft supports 23 are each formed to be thin and long in the front-rear direction in the entirety of the intermediate region 55, for example, in plan view (refer to FIG. 6) of the slider body 10. Further, in the left-right direction, the left and right shaft supports 23 are disposed to be placed between the left and right clearance recesses 22 (in other words, placed in a range on the inner side of the left and right clearance recesses 22) and are provided to include a boundary between the central region 51 and each of the side regions 52.

A central recess 26 that is recessed such that a central portion in the width direction is lowest is provided between the left and right shaft supports 23 in the present embodiment. The left and right shaft supports 23 are thus disposed away from each other. With the central recess 26 being thus formed between the left and right shaft supports 23, for example, when a pull of a rotary type in which left and right arm portions of the pull and an attachment shaft portion are formed in a circular arc shape is held, instead of the pull 30 in the present embodiment, between the upper blade 20 and the cover body 40, it is possible to rotate the pull of the rotary type leftward and rightward easily with respect to the slider body.

In the present invention, it is sufficient for the shaft supports 23 of the upper blade 20 to be provided such that at least a part of the shaft supports 23 is disposed in the intermediate region 55 in the up-down direction in plan view of the slider body 10. Therefore, in the present invention, for example, one shaft support may be provided in the central region in the left-right direction. Alternatively, for example, a left-right pair of shaft supports may be each provided at a portion close to the outer side in the width direction in a corresponding one of the left and right side regions. In addition, in the present invention, the shaft supports may be provided in only part of the intermediate region, not in the entirety of the intermediate region, in the front-rear direction. Further, although the support surfaces of the shaft supports 23 are each disposed at a height position same as the height position of the reference surface 21 of the upper blade 20, as described above, in the up-down direction in the present embodiment, the shaft supports may be formed in the present invention such that the height position of each of the support surfaces is changed in a range from the reference surface of the upper blade to the tip surfaces of the projections in the up-down direction.

In the slider body 10 in the present embodiment, the first attachment column 14 and the second attachment column 15 are formed to extend upward from the upper blade 20. In addition, the first attachment column 14 and the second attachment column 15 are disposed away from each other in the front-rear direction. Consequently, a space portion capable of accommodating the attachment shaft portion 33 of the pull 30 is provided between the first attachment column 14 and the second attachment column 15.

The first attachment column 14 and the second attachment column 15 of the slider body 10 are covered by the cover body 40, and the cover body 40 is fixed to the first attachment column 14 and the second attachment column 15 and is thereby attached to the slider body 10 (refer to FIG. 3). In the present embodiment, after the first attachment column 14 and the second attachment column 15 are covered by the cover body 40, a part of the cover body 40 is pressed partially to be plastically deformed, and the cover body 40 is thereby fixed to the first attachment column 14 and the second attachment column 15. In the present invention, the method and means of fixing the cover body 40 to the first attachment column 14 and the second attachment column 15 of the slider body 10 are not particularly limited.

For attachment of the plate spring member (elastic member), which is not illustrated, the first attachment column 14 on the front side is provided with left and right first spring supports 14*a* that support the plate spring member, and a first protrusion 14*b* that engages with the plate spring member. The first attachment column 14 is also provided with a pawl accommodation recess 14*c* that accommodates a part of the stopper pawl body (not illustrated), and the first inclined surface 14*d* that is inclined downward toward the rear. The first inclined surface 14*d* of the first attachment column 14 is provided at a rear end portion of the first attachment column 14 facing the second attachment column 15.

For attachment of the plate spring member (elastic member), the second attachment column 15 on the rear side is provided with a second spring support 15*a* that supports the plate spring member, and a second protrusion 15*b* that protrudes upward further than the second spring support 15*a* and that engages with the plate spring member. The second attachment column 15 is also provided with a pawl hole 15*c* that is in communication with the element guide passage 18, and the second inclined surface 15*d* that is inclined downward toward the front. Due to the provision of the pawl hole 15*c*, part (pawl portion) of the stopper pawl body that is urged by the plate spring member can enter the element guide passage 18. The second inclined surface 15*d* of the second attachment column 15 is provided at a front end portion of the second attachment column 15 facing the first attachment column 14.

In the present invention, as long as the first attachment column 14 and the second attachment column 15 of the slider body 10 are formed at least such that the cover body 40 can be attached thereto, the shapes, structures, sizes, and the like of the first attachment column 14 and the second attachment column 15 are not particularly limited.

When the slider in the present embodiment is to be assembled using the slider body 10, the pull 30, the stopper pawl body (not illustrated), the elastic member (not illustrated), and the cover body 40 that are described above, the pull 30 is first placed at the upper blade 20 of the slider body 10. At this time, as illustrated in FIG. 1 and FIG. 2, the attachment shaft portion 33 of the pull 30 is inserted into the gap between the first attachment column 14 and the second attachment column 15 of the slider body 10 while the first attachment column 14 or the second attachment column 15 is inserted into the open window portion of the pull 30. At this time, the attachment shaft portion 33 of the pull 30 is placed at the left and right shaft supports 23 of the upper blade 20, and the attachment shaft portion 33 is thereby supported by the shaft supports 23.

Next, the stopper pawl body and the elastic member are sequentially placed at the slider body 10 at which the pull 30 has been placed. To place the stopper pawl body at the slider body 10, a part of the stopper pawl body is inserted into the pawl accommodation recess 14*c* provided on the first attachment column 14 of the slider body 10 while the pawl portion of the stopper pawl is inserted into the pawl hole 15*c* provided in the second attachment column 15.

Thereafter, the cover body 40 is attached to the slider body 10 at which the pull 30, the stopper pawl body, and the elastic member have been placed. At this time, The first attachment column 14 and the second attachment column 15 of the slider body 10 are covered by the cover body 40 such that the first attachment column 14 and the second attachment column 15 are accommodated in the cover body 40. Further, a part of the cover body 40 is pressed to be elastically deformed to thereby fix the cover body 40 to the first attachment column 14 and the second attachment column 15.

Consequently, the slider in the present embodiment in which the attachment shaft portion 33 of the pull 30 is disposed between the first attachment column 14 and the second attachment column 15 of the slider body 10 and in which the attachment shaft portion 33 is held between the upper blade 20 and the cover body 40 is manufactured.

According to the slider in the present embodiment described above, for example, when the pull 30 is tilted toward (toward the rear) the rear port 17 with respect to the slider body 10, the attachment shaft portion 33 of the pull 30 is supported by the left and right shaft supports 23 of the slider body 10 while the left and right arm portions 32 of the pull 30 are supported by the left and right second projections 24*b* of the slider body 10 (refer to FIG. 4). In this case, the pull 30 is in contact with only the left and right shaft supports 23 and the left and right second projections 24*b* serving as portions of the slider body 10 supporting the pull 30 and is supported by the slider body 10. Further, the slider body 10 in the present embodiment is provided with the left and right clearance recesses 22 in the left and right side regions 52 of the upper blade 20, respectively. Consequently, a gap can be provided between the bottom surface 22*a* of each of the clearance recesses 22 and the pull 30.

With such a gap being formed, a non-contact region 59 in which the pull 30 does not come into contact with the upper blade 20 is provided between the upper blade 20 and the pull 30 tilted toward the rear in side view (FIG. 4) of the slider in which the slider is viewed in the left-right direction. In the present embodiment, the non-contact region 59 is provided at least in a range from the position of the front edge of the second attachment column 15 to the position of the rear end 22*c* of each of the clearance recesses 22 in the front-rear direction. The range from the position of the front edge of the second attachment column 15 to the position of the rear end 22*c* of each of the clearance recesses 22 can be expressed in other words as a range in the rear region 57 in which the clearance recesses 22 are provided. In particular, in the present embodiment, the non-contact region 59 is provided at least in the entirety of a range (in other words, the range of the reference dimension L2) from the position of the center of the attachment shaft portion 33 of the pull 30 to the position of contact between the pull 30 and the second projections 24*b* in the front-rear direction.

As a result, the area of a portion in which the pull 30 tilted toward the rear comes into contact with the slider body 10 can be greatly reduced compared with, for example, sliders in the related art, such as that in PTL 1. In the present invention, for example, depending on the set position and the size of each of the clearance recesses 22 and the shape, the size, and the like of the pull 30, the pull 30 may come into contact with the slider body 10 at a portion other than the left and right shaft supports 23 and other than the left and right second projections 24*b* when the pull 30 is tilted toward the rear.

When the pull 30 is tilted toward (toward the front) the shoulder ports 16 with respect to the slider body 10, the attachment shaft portion 33 of the pull 30 is supported by the left and right shaft supports 23 of the slider body 10, and the left and right arm portions 32 of the pull 30 are supported by the left and right first projections 24*a* of the slider body 10. At this time, the first projections 24*a* on the front side are disposed at positions closer than the second projections 24*b* on the rear side to the attachment shaft portion 33 of the pull 30 in side view (refer to, for example, FIG. 3) of the slider. Consequently, when the pull 30 is tilted toward the front, the pull 30 can be held to be inclined at a larger inclination angle with respect to the reference surface 21 of the upper blade 20 compared with, for example, the pull 30 that is tilted toward the rear. It is thus possible to reduce the area in which the pull 30 comes into contact with the upper blade 20.

Due to the left and right clearance recesses 22 being thus provided at the upper blade 20, it is possible in the slider in the present embodiment to significantly reduce the contact area in which the pull 30 comes into contact with the upper blade 20 of the slider body 10 when the pull 30 is tilted toward the front or toward the rear, compared with, for example, general sliders in the related art. Accordingly, when the slider in the present embodiment is subjected to a coating process such as coating by a spray and the coated slider is thereafter dried, a possibility of occurrence of a problem that drying of a coating material fixes the pull 30 to the upper blade 20 and a problem that fixation of the pull 30 causes a mark of the pull 30 left on the slider body 10 can be reduced. Consequently, it is possible to reduce a coating defect of the slider, and it is thus possible to improve the productivity of the slider and increase the yield of the slider.

In addition, in the slider in the present embodiment, the left and right clearance recesses 22 of the upper blade 20 are formed parallel to the left-right direction and formed to be continuous to the left and right side edge portions 25 of the upper blade 20. Therefore, when a coating process by a spray is performed on the slider, a coating material that flows into the clearance recesses 22 of the upper blade 20 can be easily discharged to the outside in the left-right direction. It is thus possible to cause the coating material not to accumulate in the clearance recesses 22 easily and possible to coat the slider beautifully.

Further, due to the left and right clearance recesses 22 being formed to be continuous to the left and right side edge portions 25 of the upper blade 20, for example, even when a pull (for example, a pull including an attachment shaft portion that is elongated in the left-right direction) in which the dimension of the attachment shaft portion is different from that in the present embodiment is attached to the slider body 10, it is possible similarly to the present embodiment to prevent or suppress fixation of the pull to the upper blade 20 after a coating process.

As described above, in the slider in the present embodiment, the bottom surface 22*a* of each of the clearance recesses 22 is formed in a smooth recessed surface shape and is smoothly continuous with the reference surface 21 at the front and rear thereof. Further, each of the clearance recesses 22 is formed such that the depth thereof with respect to the reference surface 21 is shallow and is formed to have a small dimension in the front-rear direction in a range in which an effect capable of reducing the area of contact between the pull 30 and the upper blade 20 can be obtained. Furthermore, in the slider in the present embodiment, when the pull 30 is tilted toward the rear port 17 as illustrated in, for example, FIG. 1 and FIG. 2, the left and right clearance recesses 22 provided at the upper blade 20 can be covered by the pull 30 so as not to be easily seen.

Consequently, even when the clearance recesses 22 are provided at the upper blade 20, it is possible as described above to make the clearance recesses 22 less noticeable in the external appearance of the slider. It is also possible to reduce a possibility of fingers or nails being caught in the clearance recesses 22 of the upper blade 20 when, for example, a sliding operation of the slider is performed. Accordingly, it is possible in the slider in the present embodiment to obtain the same quality as sliders in the related art.

Therefore, for example, even when the slider in the present embodiment is attached instead of a slider in the related art to element rows of a fastener chain, a possibility of a user feeling uncomfortableness can be reduced. In addition, in fastener-attached products such as clothes and bags, a change in the influence of the slide fastener on the outward appearance, design characteristics, and the like of the fastener-attached products can be suppressed to be small.

Note that the present invention is not limited to the above-described embodiment at all, and various changes are possible as long as the changes have configurations substantially identical to those of the present invention and exert similar effects.

For example, as described above, the slider in the above-described embodiment is used mainly in a slide fastener in which element rows are formed by a plurality of fastener elements that are continuous in a coil shape. However, the slider according to the present invention may be formed to be used for, for example, a slide fastener in which element rows are formed by a plurality of metallic fastener elements or a slide fastener in which a plurality of independent fastener elements are formed at a fastener tape by injection molding of a synthetic resin.

In addition, in the slider in the above-described embodiment, the four projections 24, including the two first projections 24*a* on the front side and the two second projections 24*b* on the rear side, are provided at the upper blade 20. However, it is sufficient in the present invention that the upper blade 20 is provided with at least one projection 24 on the rear side of the intermediate region 55. Thus, for example, the slider body may be formed with no projection provided on the front side of the intermediate region.

REFERENCE SIGNS LIST

10 slider body
11 lower blade
11*a* bulge portion
12 coupling column
13 upper flange portion
14 first attachment column (front attachment column)
14*a* first spring support
14*b* first protrusion
14*c* pawl accommodation recess
14*d* first inclined surface
15 second attachment column (rear attachment column)
15*a* second spring support
15*b* second protrusion
15*c* pawl hole
15*d* second inclined surface
16 shoulder port
17 rear port
18 element guide passage
19 tape insertion gap
20 upper blade
21 reference surface (upper surface)
22 clearance recess
22*a* bottom surface
22*b* front end (front edge)
22*c* rear end (rear edge)
23 shaft support
24 projection
24*a* first projection
24*b* second projection
25 side edge portion
26 central recess
30 pull
31 pull body portion
32 arm portion
33 attachment shaft portion
40 cover body
51 central region
52 side region
55 intermediate region
56 front region
57 rear region
59 non-contact region
D maximum depth of clearance recess
L1 length dimension of clearance recess
L2 reference dimension

The invention claimed is:

1. A slider comprising at least a slider body, a pull including an attachment shaft portion, and a cover body, the slider body including an upper blade, a lower blade disposed away from the upper blade, a coupling column coupling a front end portion of the upper blade and a front end portion of the lower blade, a first attachment column on a front side, and a second attachment column on a rear side, the first attachment column and the second attachment column extending upward from the upper blade, the cover body being attached to the first attachment column and the second attachment column of the slider body, the attachment shaft portion of the pull being disposed between the first attachment column and the second attachment column of the slider body and being held between the upper blade and the cover body, the slider being for a slide fastener, wherein the upper blade includes a reference surface that is exposed to an upper side, a clearance recess that has a shape recessed with respect to the reference surface, and a projection that projects from the reference surface and that supports a part of the pull when the pull is tilted with respect to the slider body, the reference surface and the clearance recess are disposed in each of left side and right side regions on an outer side of the first attachment column and the second attachment column in a slider width direction, the clearance recess is disposed to include at least a part of an intermediate region that is provided between the first attachment column and the second attachment column in a slider length direction, the projection is disposed at a rear of the intermediate region in the slider length direction, the upper blade includes a shaft support that supports the attachment shaft portion of the pull, and the shaft support is disposed inside the clearance recesses disposed in the left side and right side regions in the slider width direction and is disposed at a height position same as a height position of the reference surface in a slider height direction.

2. The slider according to claim 1, wherein the shaft support is disposed in at least a part of the intermediate region in the slider length direction.

3. The slider according to claim 1, wherein in the slider length direction, a front end of the clearance recess is disposed forward the intermediate region, and a rear end of the clearance recess is disposed between the intermediate region and the projection.

4. The slider according to claim 1, wherein the clearance recess has a bottom surface that is curved into a shape recessed with respect to the slider length direction, and the bottom surface of the clearance recess is formed to be smoothly continuous from the reference surface.

5. The slider according to claim 1, wherein a bottom surface of the clearance recess is formed by a curved surface that is parallel to the slider width direction.

6. The slider according to claim 1, wherein in side view of the slider in which the slider is viewed in the slider width direction, a non-contact region in which the pull does not come into contact with the upper blade is provided between the upper blade and the pull when the pull is tilted with respect to the slider body.

7. The slider according to claim 1, wherein in side view of the slider in which the slider is viewed in the slider width direction, when a dimension from a position of a center of the attachment shaft portion of the pull while the pull is tilted with respect to the slider body to a position of a tip of the projection in the slider length direction is defined as a reference dimension, a dimension from a front end of the clearance recess to a rear end of the clearance recess in the slider length direction is 50% or more of the reference dimension.

8. The slider according to claim 1, wherein a maximum depth of the clearance recess from the reference surface in the slider height direction is 2% or more and 10% or less of a dimension of the upper blade from the reference surface to a lower surface of the upper blade in the slider height direction.

* * * * *